US006435637B1

(12) United States Patent
Lyman

(10) Patent No.: US 6,435,637 B1
(45) Date of Patent: Aug. 20, 2002

(54) FLUID AND VACUUM CONTROL IN AN INK JET PRINTING SYSTEM

(75) Inventor: Dan C. Lyman, Cincinnati, OH (US)

(73) Assignee: Scitex Digital Printing, Inc., Dayton, OH (US)

( * ) Notice: Subject to any disclaimer, the term of this patent is extended or adjusted under 35 U.S.C. 154(b) by 0 days.

(21) Appl. No.: 09/430,719

(22) Filed: Oct. 29, 1999

(51) Int. Cl.[7] ..... B41J 2/175

(52) U.S. Cl. ..... 347/5

(58) Field of Search ..... 347/9, 5, 6, 17

(56) References Cited

U.S. PATENT DOCUMENTS 5,394,177 A * 2/1995 McCann et al. ..... 347/7

* cited by examiner

*Primary Examiner*—Huan Tran
(74) *Attorney, Agent, or Firm*—Barbara Joan Haushalter

(57) ABSTRACT

A system and method are provided for improving the control of vacuum and pressure in an ink jet printing system. The control is positively affected by reducing response time of the system, minimizing overshoot of the controlled parameters, such as ink pressure or system vacuum, eliminating steady state oscillations, and reducing the magnitude of the excursions of the controlled parameter in response to load changes.

14 Claims, 4 Drawing Sheets

FLUID AND VACUUM CONTROL IN AN INK JET PRINTING SYSTEM

TECHNICAL FIELD

The present invention relates to the field of continuous ink jet printing and, more particularly, to improved control of fluids and vacuum in a continuous ink jet printing system.

BACKGROUND ART

In continuous ink jet printing systems, it is necessary to control vacuum and pressure levels to specific targets. These target levels change as the system is stepped through various states associated with preparing the printhead for printing, shutting down the printhead, cleaning the printhead, or flushing the system.

In previous systems, proportional-integral-differential (PID) control algorithms were used to servo the system to the target values. Unfortunately, while one set of PID control constants resulted in good system response (i.e., quick response, minimal overshoot, no steady state oscillations) for a given valve configuration in the system, the same set of constants performed poorly for another valve configuration.

In prior art systems, to deal with the different response characteristics of the vacuum and pressure system of the ink jet printer, it was necessary to use PID control constants which insure stability (lack of oscillation) for all conditions. In general one of the valve conditions will be more prone to oscillations than the others. The control constants needed to prevent oscillation for this state will produce the response rates that are slower than desired for many of the other valve conditions.

Previous continuous ink jet printing systems contained a separate vacuum source for each printhead. In such systems, it is a relatively simple task to maintain vacuum. However, if two or more printheads use the same vacuum source, the vacuum system time constants vary more widely. The PID control constants needed to ensure stability for all valve conditions results in significantly worse response rates for some of the other valve conditions. These slow response rates become unacceptable.

Additionally, in a fluid system having a common vacuum system for two or more printheads, there will be times when a step change in the vacuum load in one system is required (when a vacuum system valve is actuated during startup, for example),while the vacuum level for the second system must be held constant. The transients produced at such times can result in an unacceptable excursion in the vacuum level for the second system, which can adversely affect performance of second printhead.

It is seen, then, that there exists a need for an improved fluid and vacuum control system which can maintain stability of the system while providing an acceptable response rate for the system.

SUMMARY OF THE INVENTION

This need is met by the present invention wherein a means is provided for controlling fluids and vacuum in a continuous ink jet printing system.

In accordance with one aspect of the present invention, a system and method are provided for improving the control of vacuum and pressure in an ink jet printing system. The control is positively affected by reducing response time of the system, minimizing overshoot of the controlled parameters, such as ink pressure or system vacuum, eliminating steady state oscillations, and reducing the magnitude of the excursions of the controlled parameter in response to load changes.

Other objects and advantages of the invention will be apparent from the following description, the accompanying drawing and the appended claims.

DETAILED DESCRIPTION OF THE PREFERRED EMBODIMENTS

Figure 1:
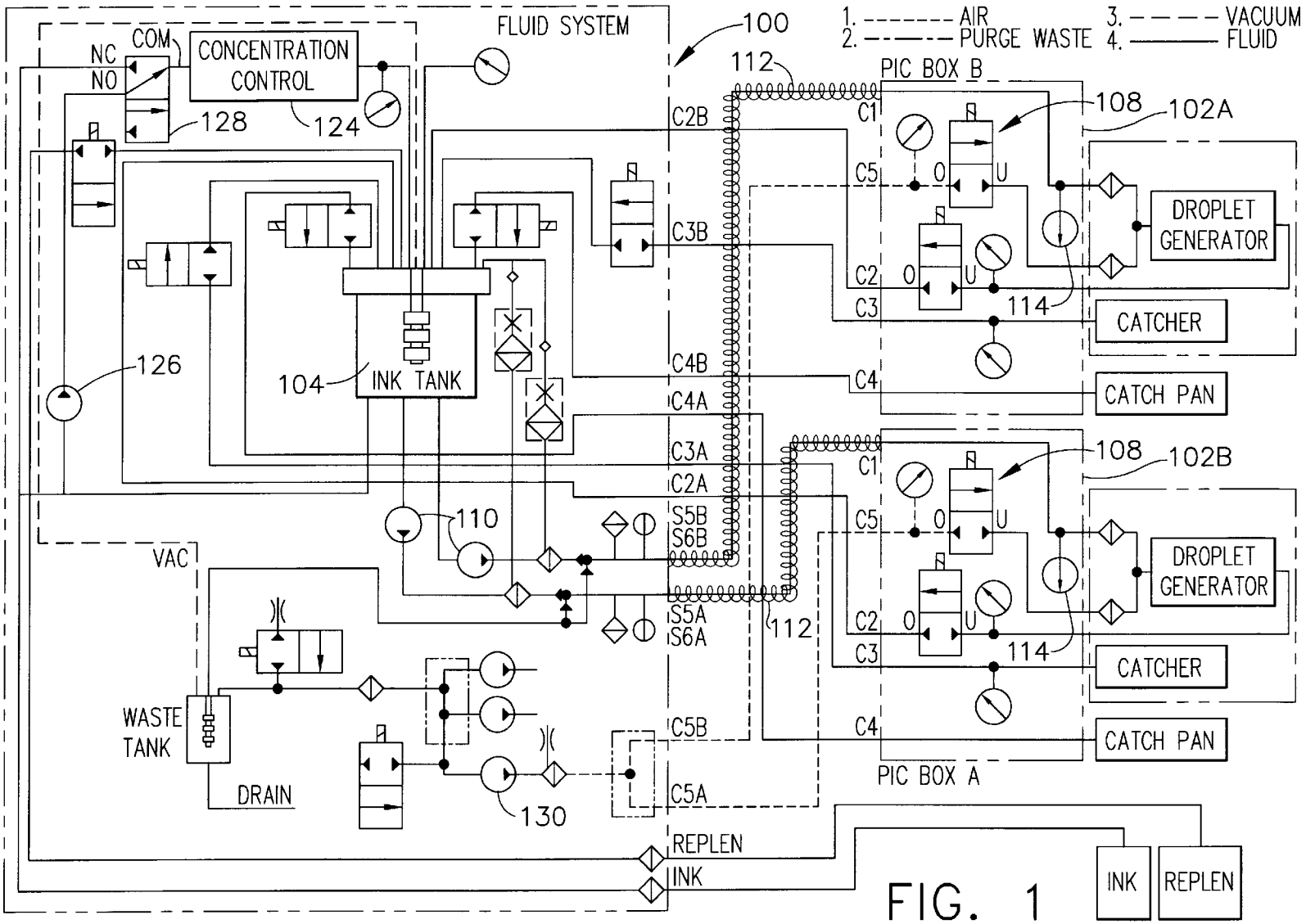
FIG. 1 is a schematic block diagram of a printing system.

In continuous ink jet printing systems, ink is supplied under pressure by a fluid system to the printhead, as shown in FIG. 1. Some of the ink drops formed by the printhead strike the paper to form the desired image. The remaining ink drops are made to strike the catcher. Vacuum in the ink reservoir is used to return the ink from the catcher back to the ink reservoir, from which it can be reused. In normal operation, it is necessary to maintain vacuum to within about 0.5 in. Hg. of the target value, and pressure within about 0.2 psi of the target in order for the system to function properly.

If vacuum is too high, uncharged drops, which should end up being printed, are instead sucked into the catcher. Large amounts of foam can also be generated in the ink reservoir. If vacuum is too low, the system cannot remove ink quickly enough from the catcher face, and ink drips down onto the print media, degrading the quality of the printed product.

Similarly, if the ink pressure is too high or too low, drop formation and drop deflection can be seriously affected, again resulting in degradation of the final product.

To maintain the proper vacuum and ink pressure levels, ink jet printers typically incorporate controller means. These controller means often include pressure and vacuum sensing means, control electronics, and means to adjust the pump speeds. The control electronics normally include a Proportional-Integrate-Differentiate (PID) control system. PID controllers are used as they can provide minimal fluctuation of the control parameters, fast settling times, and lack of oscillation.

When a PID controller is used, the stability of the controller, the response rate, and the amount of overshoot depend on the multiplier values used for each stage of the controller. The multiplier values used in the PID controller are ideally selected based on the natural response rates of the system to be controlled. Multiplier values which are different from the ideal can produce instability, that is the system can oscillate. Multiplier values on the other side of the ideal can result in slow settling times and larger than ideal fluctuations of the controlled parameter. If the system gain and response rates change for different conditions, the multiplier values used by the PID controller may no longer be optimal. If the changes are small, there may be a minor effect on the controller settling rate or overshoot. If the values change more significantly, the controller may become unstable, and could oscillate, or the settling rates or overshoot may become unacceptable.

In FIG. 1, a single fluid system 100 is illustrated, capable of independently and simultaneously controlling the integration of multiple print heads. The integration of two print heads supported by one fluid system involves both shared and additional components from the existing fluid system, and new components which enable the operation of the system.

Each print head is controlled by a separate print head interface controller (PIC) box 102*a* and 102*b*, and share a common ink reservoir or ink tank 104. The ink tank is under vacuum supplied by regulated vacuum systems means. Regulated vacuum system means could be of the type described in U.S. Pat. No. 5,394,177 or, in a preferred embodiment, as described in co-pending, commonly assigned patent application Ser. No. 09/211,777.

Ink is withdrawn from the ink tank 104 by ink pumps 110, each of which supply ink to a single print heads. Each pump 110 is driven by a variable speed brushless VDC motor which allows control of the flow rate to each print head. It is important to note that with the addition of variable flow controlled solenoid valves, one ink pump would be sufficient to supply ink to both print heads. However, other design parameters may require each print head to be assigned its own ink pump.

In addition to the ink pumps 110, each print head also has an individual ink heater of any suitable type, such as a heated umbilical 112, such as is described and claimed in commonly assigned, co-pending patent application Ser. No. 09/211,066, abandoned. A common heater controller means is used to control the two ink heaters. This controller monitors the ink temperature in each print head by means of separate temperature sensors 114 and energizes and de-energizes the ink heaters by means of separate heater control relays (not shown) to provide separate servo control of the ink temperature for the two print heads.

To minimize the electromagnetic emissions, the switching of the heater power is done at the crossover points of the AC sine wave. Since each ink heater consumes a large amount of power, the common heater controller ensures that both heaters are not energized at the same time. Rather it shares the heater power in a ping-pong fashion between the two heaters. Furthermore, during the start up sequence it is desirable for the ink temperature in the print head to rise rapidly to produce the condensation needed for cleaning the charge plate. To provide the desired rapid temperature the system controller staggers the startup sequence for the two print heads so that the heater controller can supply full power to a single heater for the time required to get the desired condensation before switching the power to the next heater to produce the desired condensation for the next print head. In this manner, the single common heater controller for the two print heads, can significantly reduce the peak current requirements for a multiple print head system. The separate ink heaters have separate thermostats (not shown) which protect the system from overheating, these thermostats are not used for temperature control.

A concentration control sensor 124, disclosed and claimed in commonly assigned, copending patent application Ser. No. 09/211,035 abandoned, monitors the ink concentration. Ink is circulated through the concentration sensor from the ink tank by a small separate fluid pump 126. In this way, the flow through the sensor is independent of the flow to either of the print heads. The concentration control system is configured such that when the fluid system 100 fills with fresh ink, ink passes through a valve 128 at the inlet of the concentration sensor and passes through the sensor. In this way, the sensor can be calibrated against fresh ink. The fluid system control electronics monitors the output of this sensor and the output of the ink tank level sensors as it controls the addition of ink or a replenishment fluid to the ink tank, similar to the existing fluid system.

Checking the concentration of make up ink with the concentration sensor as the ink is added to the fluid system can also provide a failsafe test to prevent the wrong type or color of ink from being added to the fluid system.

A positive air pump 130 supplies clean air into the fluid lines. The positive air pump in fluid system 100 provides clean air through air valves 108 to each droplet generator to help remove ink from the print heads during shutdown of both print heads. The function of this air pump is described in more detail in commonly assigned, copending patent application Ser. No. 09/211,213, U.S. Pat. No. 6,273,013.

In a typical ink jet printer, the vacuum level is controlled by the pump speed or, for control purposes, pump voltage. It is also affected by the amount of air allowed to enter the vacuum system through various air bleeds, such as open catcher and catch pan lines and other possible air bleeds. As more air bleeds are closed, a small change in pump voltage will make a bigger change in the vacuum level. That is, the gain of the vacuum system response increases as air bleed valves are closed. Opening or closing the various air bleed valves also affects the response rate or time constants of the system. Similarly the natural response of the ink pressure system depends on whether the outlet valve from the printhead is open or closed.

Figure 2A:
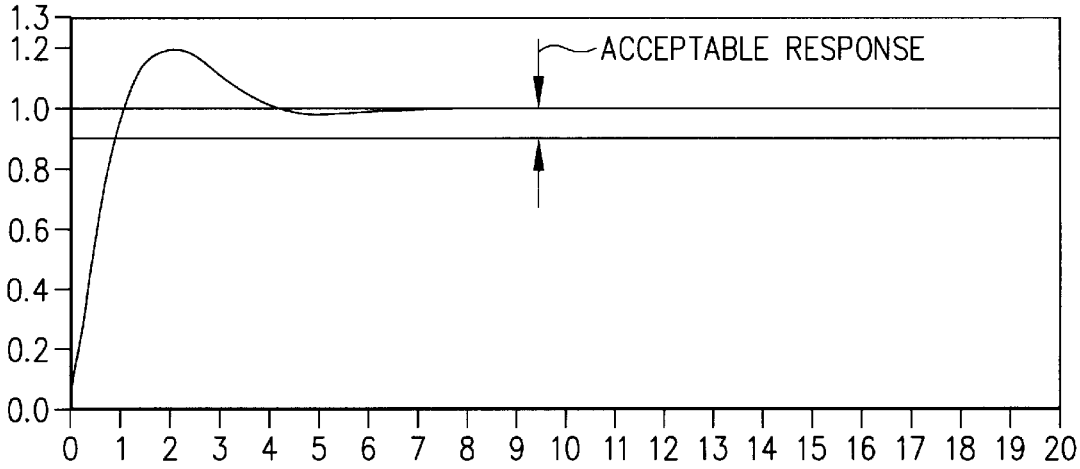
FIGS. 2A and 2B illustrate unacceptable system responses, for a system not incorporating the technique of the present invention.
Figure 2B:
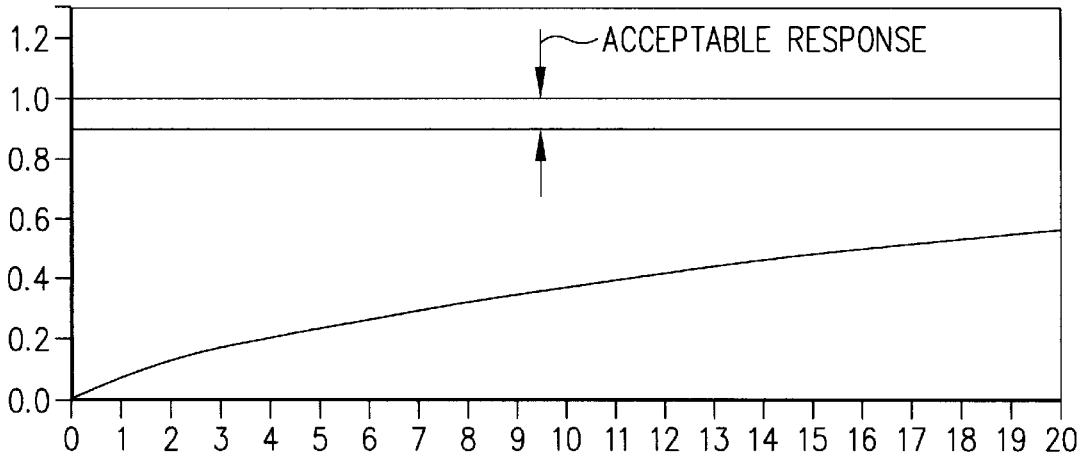
Figure 3A:
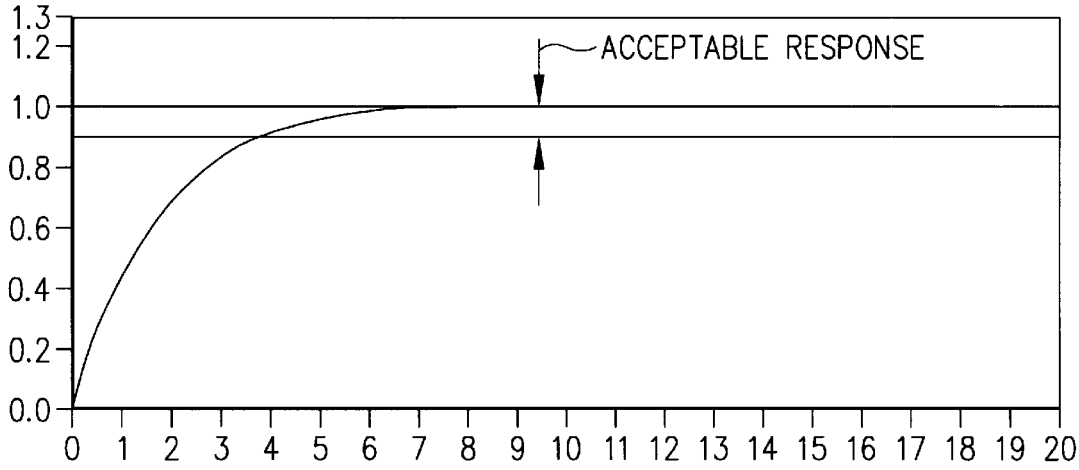
FIGS. 3A and 3B illustrate acceptable system responses, for a system incorporating the technique of the present invention.
Figure 3B:
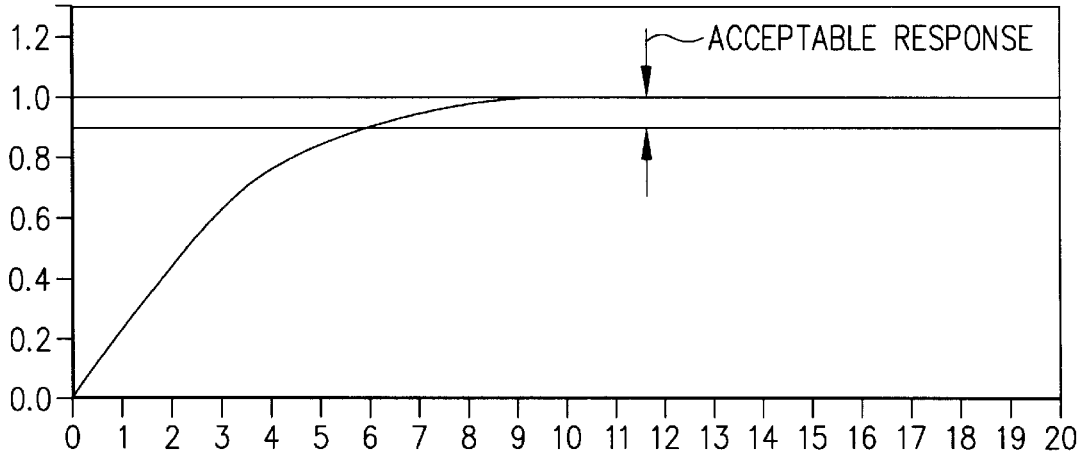

The effect of these changes in the natural system response produced by the different valve or bleed conditions is illustrated in FIGS. 2 and 3. In the graph of FIG. 3A, the response of the system is illustrated when the air bleed valves are closed and the PID controller multiplier factors are near optimum. In about 8 time units, the system has settled to the desired value. FIG. 3B illustrates a graph of the response of the system when the air bleed valves are open and the multiplier factors have been changed to near optimum for this condition. In about 10 time units, the system has settled to the desired value. These two graphs show that with properly adjusted PID controllers this controlled system can quickly settle to the desired new values with the air bleed valves open or closed.

In prior art systems a single set of PID control parameters was used for all fluid system states. This could produce unacceptable response for many of the fluid system states. For example, consider a fluid system where the PID multiplier values used (FIG. 3A) are used for all the fluid system states. In states where the valves are open, unacceptable overshoot is produced, as in FIG. 2A. In more extreme conditions, the system could perhaps go into oscillation. On the other hand consider a fluid system where the PID multiplier values used (FIG. 3B) are used for all states. When the valves are closed, as illustrated in FIG. 2B, the system can have unacceptably long response times. After twenty time units the system is still far from reaching the desired set point. This second set of PID multiplier values will avoid overshoot and oscillation for all cases, making the system more stable, but system response can be very slow in some of the operating states. In prior art systems, when faced with the choosing between these two sets of PID multiplier factors, the need to ensure stability in all conditions would dictate the use of the second set of multiplier values even with the poor response rates for some fluid system states.

Newer ink jet printing systems have a fluid system that can drive multiple printheads. Hence, the natural response characteristics of the vacuum system are affected by the catcher and catch pan valves of more than one printhead. As a result, the response characteristics change more dramatically than in earlier systems. Therefore, it is no longer a viable option to set the parameters for stability under all conditions and accept slow response for the other states.

The present invention solves this problem by using fluid system state-dependent parameters for the vacuum and pressure control systems. These parameters can then be stored in a table. For any operating state of the fluid system, the ideal PID control parameters can be obtained by selecting the data from the table specified for that operating state.

Referring again to FIG. 1, current printing system employ DC motor driven pumps to operate as the source of both vacuum and pressure. For the vacuum system, a transducer located in the ink tank provides the measured level. For the pressure system, a transducer is used to measure the pressure in the printhead.

Target values for vacuum are determined by a state table. This state table/software file contains sequences of states used to perform various evolutions (e.g. bring up or shutdown). The target value for vacuum is determined by both the state table and the printhead, since the in-catch value of vacuum is stored in the printhead.

Once the target value is established, the PID controller can adjust the drive level to the appropriate DC motor driven pump to attempt to reach and maintain that target level. In one such ink jet printer, the desired system control specifications are as follows:

(1) Pressure—Starting from a steady state level of 5 psi, a step change in the target value from 5 to 15 psi should result in the system reaching the desired value (15 psi) in less than 8 seconds, and overshooting by less than 1 psi. Similarly, a step in the target from 15 psi to 5 psi would result in the system reaching the 5 psi target in less than 8 seconds and undershoot by less than 1 psi. After such transients, the pressure should be held to within 0.2 psi of the target value.

(2) Vacuum—Starting from a steady state level of 5 in. Hg., a step change in the target value from 5 to 15 in. Hg. would result in the system reaching the desired value (15 in. Hg.) in less than 8 seconds, and overshooting by less than 1 in. Hg. Similarly, a step in the target from 15 in. Hg. to 5 in. Hg. would result in the system reaching the 5 in. Hg. target in less than 8 seconds and undershoot by less than 1 in. Hg. After such transients, the vacuum level should be held to within 0.5 in. Hg of the target value.

These criteria apply regardless of the valve configuration of the system.

There are two valves for each printhead which have a dominant effect on the vacuum system plant response. These include the catcher valve and the catchpan valve. The system used by way of example herein has two printheads. Since there are four valves total, there are sixteen possible valve configurations. However, some of these configurations are redundant in terms of the vacuum system response. That is, if the "A" side catcher valve is open, and the "B" side catchpan valve is open, the response will be the same as if the "B" side catcher is open and the "A" side catchpan is open. This narrows the number of configurations that the control system is required to address down to eight. By empirically determining the system response in each of these eight configurations, a table of PID constants is developed in accordance with the present invention which enables the system to tailor its control algorithm to the system configuration.

The pressure system natural response is much less complex since there is only one valve, the crossflush valve, which has an impact on the system response. Additionally, the two sides operate independently. That is, the configuration of side "A" does not affect operation of side "B" , and vice-versa. Therefore, only two sets of constants are required for the pressure response table. One set for the crossflush valve open, and one set for the crossflush valve closed.

In a preferred embodiment, digital signal processing techniques can be used to implement the PID controller. In a digital implementation (see FIG. 4), the analog signals from the pressure and vacuum sensors are read by an analog to digital convertor. The output from this device is a stream of numbers corresponding to the input values at the sampling times. For each sampling time, difference between the desired target value and the measured values is computed to produce an error value. A proportional output is produced by multiplying the error value by the desired constant. At each sampling time, an integration of the error value can be approximated by adding up the present error value to the sum of all preceding error values. This sum is then multiplied by the integration multiplier factor. A differentiation can be approximated by the difference between the consecutive error values. This difference can then be multiplied by the differentiation multiplier factor. The outputs from the proportional, integration, and differentiation stages are summed together to yield the desired controller output value. A digital to analog converter is then used to convert the digital value back to an analog value for controlling the appropriate pump speed.

Figure 4:
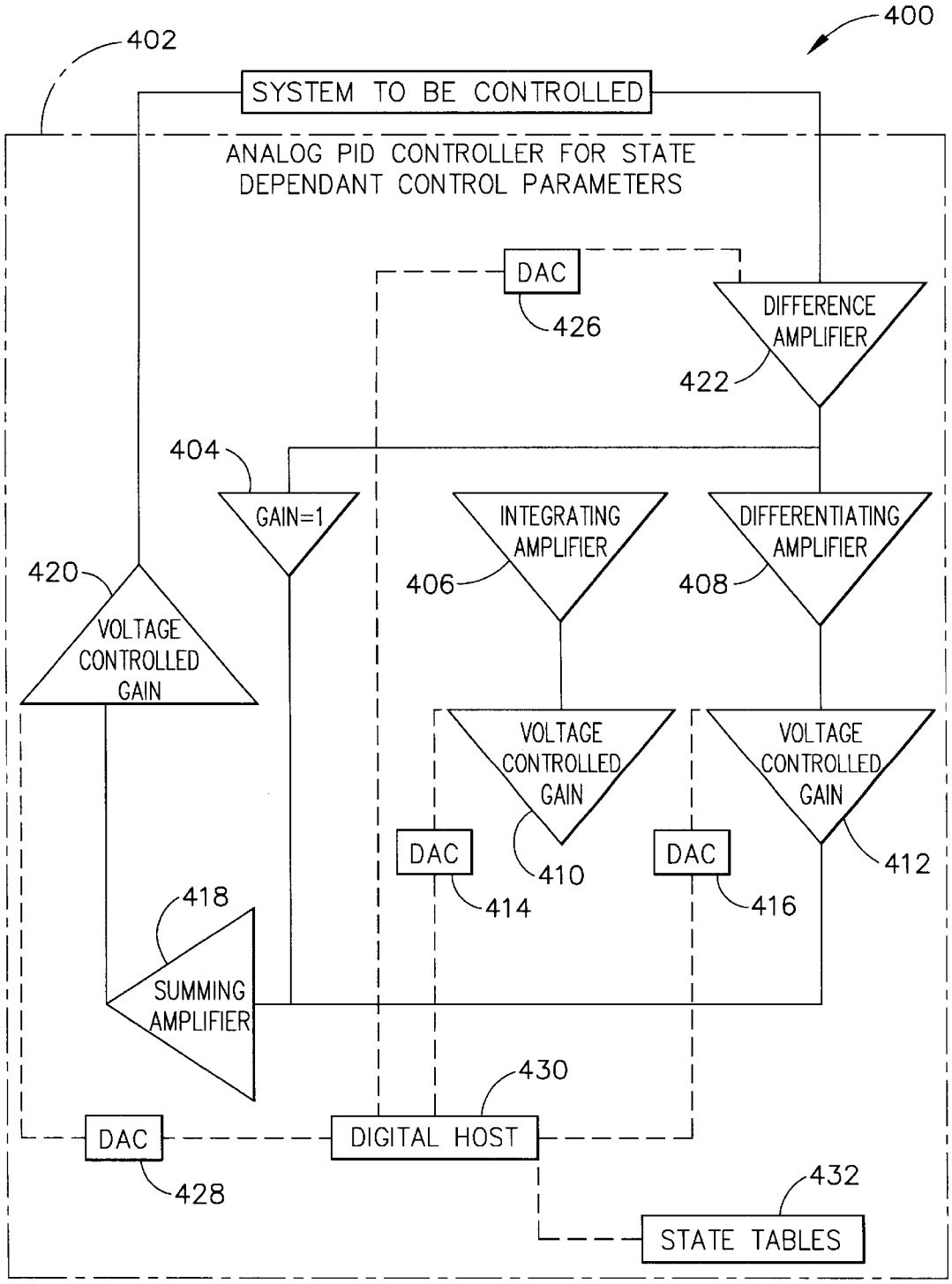
FIG. 4 is a schematic block diagram of an analog PID controller, in accordance with one embodiment of the present invention

Alternatively an analog PID control circuit may be used. The block diagram of FIG. 4 illustrates an analog PID circuit 400 for use with state dependent PID control parameters. The controller 402 has an input stage 422 which compares the system output 424 to a digitally controlled set point 426. The controller then has parallel proportional (gain of one) 404, integrate 406, and differentiate 408 stages. The gains of the integrate and differentiate stages have amplifiers with digitally controlled gains at 410 and 412, respectively, which are controlled by the outputs of digital-to-analog converters 414 and 416, respectively. The output from these three stages are summed at 418. Finally, the overall gain of the feedback system at 420 is set by a digitally controlled amplifier. A digital host system 430 can set the control set point and the multiplier value for each stage of the controller by means of the digital to analog convertors 414, 416, 426 and 428. The state tables 432, which contain the control information for the valve opening-closing conditions and other system parameters with the present invention also contain the proper state dependent multiplier values for use in each operating state. As the fluid system is sequenced through the various operating states, the digital host can identify from the state table the proper control parameter values and implement them in this analog control system. This system provides the desired ability to adjust the PID parameters as needed for each fluid system state. The controller uses an analog circuit for the control function, but all the gains are digitally controlled.

In the vacuum control system, valve actuations result in a vacuum excursions which, depending upon the magnitude, could affect print quality. For example, by installing the catchpan (and thereby opening up the catchpan line) the vacuum would momentarily dip by several in. Hg. Eventually the PID controller is able to adjust the pump voltage so that the desired vacuum is produced, but a significant vacuum level transient is produced. For proper operation of the printer, it would be desirable to reduce the amplitude of the transient vacuum excursions below that obtained by the PID controller.

To understand how this can be achieved, it is helpful to understand the following. When the system is maintained at the desired vacuum, the error signal is zero. The time derivative is also zero. Therefore the output signal from proportional and differentiate stages of the PID controller are essentially zero. The output from the PID controller therefore almost totally corresponds to the output of the integrator stage. The output of the integrate stage, precisely because it is an integration, is slow to respond to changes in the vacuum. Smaller transient excursions and faster response would be achieved if the integrate stage could be made to quickly respond to the state to state changes. This can be achieved by recognizing that immediately following a state change that the integrated error value from just before the state change is no longer valid or helpful for reaching the new target value. It is therefore preferred to clear the integration output and start with a new value. A good seed value for the integrator for any operating state corresponds to the final output value of the integrator for that state in the steady state condition. In this way the seed values can be determined empirically.

A state dependent PID controller can have an integrator preset. Such a controller is like the preceding digital PID controller except now the digital control has means to clear and preset the summation value of the integration stage. The clearing and preset function is carried out as indicated in the state table when a state change is likely to produce a transient variation in the control parameter. In an alternative embodiment of this invention, the clearing and presetting of the integrator value would actually precede the valve actuations which produce the transient response. This technique of clearing and presetting the integrator stage has the desirable effect of reducing the system response time, and can therefore be applied to the pressure servo algorithm.

The invention has been described in detail with particular reference to certain preferred embodiments thereof, but it will be understood that modifications and variations can be effected within the spirit and scope of the invention. In particular, the description above employed dc servo driven pumps for controlling the ink pressure and system vacuum. Alternate means for controlling these parameters such as actuator controlled flow restrictors could also be used. These same type of control system can be used to control other operating parameters as well. These might include ink temperature or concentration. It must be further recognized that some systems may not require either the integrate or differentiate portion of a full PID controller. For such systems a Proportional-Differentiate controller or a Proportional-Integrate controller may be used, where the gains of the two stages of sections of the controller may be changed for the different operating states.

What is claimed is:

1. A system for controlling a selected parameter in a device having multiple operating states wherein the operating parameter must be controlled in at least two states of the device having differing operating natural response characteristics, the system comprising:

a multi-stage servo controller for controlling said selected operating parameter, different stages of the controller having differing gains;

a plurality of sets of control parameters for said multi-stage servo controller; and means for selecting an appropriate one of the plurality of sets of control parameters to be used by said multi-stage servo controller to maintain control of the selected operating parameter in each of the multiple operating states.

2. A system as claimed in claim 1 wherein the multi-stage servo controller comprises a multi-stage servo controller having proportional and integrating stages.

3. A system as claimed in claim 2 further comprising means for resetting an output from the integrating stage when changing between the multiple operating states.

4. A system as claimed in claim 1 wherein the multi-stage servo controller comprises a multi-stage servo controller having proportional and differentiating stages.

5. A system as claimed in claim 1 further comprising means for changing a gain of at least one of the stages of the multi-stage servo controller.

6. A system as claimed in claim 1 wherein the plurality of sets of control parameters comprise multiplier factors for use in the multi-stage servo controller.

7. A system as claimed in claim 1 further comprising means for changing a target value for the selected operating parameter.

8. A method for controlling a selected parameter in a device having multiple operating states wherein the operating parameter must be controlled in at least two states of the device having differing operating natural response characteristics, the method comprising the steps of:

using a multi-stage servo controller to control said selected operating parameter, wherein different stages of the controller have differing gains;

providing a plurality of sets of control parameters for said multi-stage servo controller; and selecting an appropriate one of the plurality of sets of control parameters to be used by said multi-stage servo controller to maintain control of the selected operating parameter in each of the multiple operating states.

9. A method as claimed in claim 8 wherein the step of using a multi-stage servo controller comprises the step of using a multi-stage servo controller having proportional and integrating stages.

10. A method as claimed in claim 9 further comprising the step of resetting an output from the integrating stage when changing between the multiple operating states.

11. A method as claimed in claim 8 wherein the step of using a multi-stage servo controller comprises the step of using a multi-stage servo controller having proportional and differentiating stages.

12. A method as claimed in claim 8 further comprising the step of changing a gain of at least one of the stages of the multi-stage servo controller.

13. A method as claimed in claim 8 wherein the step of providing a plurality of sets of control parameters comprises the step of providing multiplier factors for use in the multi-stage servo controller.

14. A method as claimed in claim 8 further comprising the step of changing a target value for the selected operating parameter.

* * * * *